US012716118B2

(12) United States Patent
Shibata et al.

(10) Patent No.: US 12,716,118 B2
(45) Date of Patent: Aug. 25, 2026

(54) METHOD FOR MANUFACTURING ALUMINUM ALLOY EXTRUDED MATERIAL WITH HIGH STRENGTH AND EXCELLENT IN SCC RESISTANCE AND HARDENABILITY

(71) Applicant: AISIN KEIKINZOKU CO., LTD., Imizu (JP)

(72) Inventors: Karin Shibata, Imizu (JP); Hiroaki Matsui, Imizu (JP)

(73) Assignee: AISIN KEIKINZOKU CO., LTD. (JP)

( * ) Notice: Subject to any disclaimer, the term of this patent is extended or adjusted under 35 U.S.C. 154(b) by 287 days.

(21) Appl. No.: 18/351,798

(22) Filed: Jul. 13, 2023

(65) Prior Publication Data

US 2023/0357902 A1 Nov. 9, 2023

Related U.S. Application Data

(63) Continuation of application No. PCT/JP2022/004671, filed on Feb. 7, 2022.

(30) Foreign Application Priority Data

Feb. 25, 2021 (JP) ..... 2021-028172

(51) Int. Cl.
*C22F 1/053* (2006.01)
*B21C 23/00* (2006.01)
*C22C 21/10* (2006.01)

(52) U.S. Cl.
CPC ..... *C22C 21/10* (2013.01); *B21C 23/002* (2013.01); *C22F 1/053* (2013.01)

(58) Field of Classification Search
CPC ..... C22F 1/053; C22C 21/10
See application file for complete search history.

(56) References Cited

U.S. PATENT DOCUMENTS

2014/0209223 A1 7/2014 Hashimoto et al.
2017/0166997 A1 6/2017 Arbab et al.
(Continued)

FOREIGN PATENT DOCUMENTS

EP 3929320 A1 12/2021
JP H09-310141 A 12/1997
(Continued)

OTHER PUBLICATIONS

International Search Report for corresponding International Patent Application No. PCT/JP2022/004671 dated Mar. 15, 2022, with English translation (6 Pages).
(Continued)

*Primary Examiner* — Vanessa T. Luk
(74) *Attorney, Agent, or Firm* — Harness, Dickey & Pierce, P.L.C.

(57) ABSTRACT

The method includes casting a billet of an aluminum alloy composition including, by mass: 6.0 to 8.0% of Zn, 1.5 to 3.0% of Mg, 0.20 to 1.50% of Cu, 0.10 to 0.25% of Zr, 0.005 to 0.05% of Ti, 0.15 to 0.35% of Mn, 0.25% or less of Sr, and 0.25 to 0.50% of a total of [Mn+Zr+Sr], and a balance including Al and unavoidable impurities, cooling the billet at a rate equal to or higher than a cooling rate of 50° C./hr after homogenization treatment at 480 to 520° C. for 1 to 14 hours, extruding an extruded material by using the billet subjected to the homogenization treatment so that a temperature of the extruded material directly after extruding becomes 325 to 550° C., cooling the extruded material at a rate of a cooling rate of 50 to 750° C./min directly after extruding, and applying two-stage artificial aging treatment.

3 Claims, 3 Drawing Sheets

| MANUFACTURING CONDITIONS | | CASTING RATE | HOMO | | AFTER HOMO | BILLET CRYSTAL GRAIN SIZE | BLT TEMPER-ATURE | PROFILE TEMPERATURE AFTER EXTRUDED | COOLING START PROFILE TEMPERATURE | COOLING RATE AFTER EXTRUDED | HEAT TREATMENT CONDITIONS | | | | |
|---|---|---|---|---|---|---|---|---|---|---|---|---|---|---|---|
| | | | TEMPER-ATURE | TIME PERIOD | COOLING RATE | | | | | | FIRST-STAGE TEMPER-ATURE | SECOND-STAGE TEMPER-ATURE | FIRST-STAGE TIME PERIOD | SECOND-STAGE TIME PERIOD | ENTIRE TIME PERIOD |
| | | 50 mm/min OR HIGHER | 480~520℃ | 1~14hr | 50°C/hr OR HIGHER | 250 μm OR LESS | 400°C OR HIGHER | 325°C OR HIGHER | 325~550℃ | 50~750 ℃/min | 90~130℃ | 130~180℃ | 1~8hr | 1~20hr | 3~24hr |
| 1 | EXAMPLE | 70 | 495 | 6 | 100 | 180 | 503 | 450 | 350 | 372 | 130 | 135 | 3.5 | 7.5 | 11 |
| 2 | EXAMPLE | 70 | 495 | 6 | 100 | 180 | 503 | 450 | 350 | 372 | 130 | 135 | 3.5 | 7.5 | 11 |
| 3 | EXAMPLE | 70 | 495 | 6 | 100 | 200 | 500 | 453 | 400 | 383 | 130 | 135 | 3.5 | 7.5 | 11 |
| 4 | EXAMPLE | 70 | 495 | 6 | 100 | 200 | 500 | 453 | 400 | 383 | 130 | 135 | 3.5 | 7.5 | 11 |
| 5 | EXAMPLE | 70 | 495 | 6 | 100 | 190 | 505 | 463 | 520 | 392 | 130 | 135 | 3.5 | 7.5 | 11 |
| 6 | EXAMPLE | 70 | 495 | 6 | 100 | 190 | 505 | 463 | 520 | 392 | 130 | 135 | 3.5 | 7.5 | 11 |
| 7 | EXAMPLE | 70 | 490 | 5 | 100 | 185 | 498 | 452 | 350 | 385 | 130 | 135 | 3.5 | 15.5 | 19 |
| 8 | EXAMPLE | 70 | 490 | 5 | 100 | 185 | 498 | 452 | 350 | 385 | 130 | 135 | 3.5 | 15.5 | 19 |
| 9 | EXAMPLE | 70 | 490 | 5 | 100 | 195 | 502 | 455 | 400 | 380 | 130 | 135 | 3.5 | 15.5 | 19 |
| 10 | EXAMPLE | 70 | 490 | 5 | 100 | 195 | 502 | 455 | 400 | 380 | 130 | 135 | 3.5 | 15.5 | 19 |
| 11 | EXAMPLE | 70 | 490 | 5 | 100 | 190 | 506 | 458 | 520 | 395 | 130 | 135 | 3.5 | 15.5 | 19 |
| 12 | EXAMPLE | 70 | 490 | 5 | 100 | 190 | 506 | 458 | 520 | 395 | 130 | 135 | 3.5 | 15.5 | 19 |
| 13 | EXAMPLE | 70 | 500 | 6 | 120 | 180 | 440 | 448 | 325 | 392 | 130 | 135 | 3.5 | 7.5 | 11 |
| 14 | EXAMPLE | 70 | 500 | 6 | 120 | 180 | 440 | 448 | 350 | 388 | 130 | 135 | 3.5 | 7.5 | 11 |
| 15 | EXAMPLE | 70 | 500 | 6 | 120 | 180 | 440 | 448 | 400 | 390 | 130 | 135 | 3.5 | 7.5 | 11 |
| 16 | EXAMPLE | 70 | 500 | 6 | 120 | 190 | 440 | 450 | 350 | 400 | 130 | 135 | 3.5 | 15.5 | 19 |
| 17 | EXAMPLE | 70 | 500 | 6 | 120 | 190 | 440 | 450 | 400 | 400 | 130 | 135 | 3.5 | 15.5 | 19 |
| 1 | COMPARATIVE EXAMPLE | 60 | 480 | 12 | 100 | 300 | 430 | 440 | 400 | 380 | 120 | 140 | 4.5 | 12.5 | 19 |
| 2 | COMPARATIVE EXAMPLE | 60 | 480 | 12 | 100 | 300 | 430 | 440 | 400 | 350 | 120 | 140 | 6.5 | 12.5 | 19 |
| 3 | COMPARATIVE EXAMPLE | 80 | 520 | 6 | 90 | 225 | 450 | 473 | 520 | 100 | 95 | 140 | 4.5 | 14.5 | 19 |
| 4 | COMPARATIVE EXAMPLE | 70 | 495 | 6 | 100 | 180 | 503 | 450 | 250 | 372 | 130 | 135 | 3.5 | 7.5 | 11 |
| 5 | COMPARATIVE EXAMPLE | 70 | 490 | 5 | 40 | 190 | 506 | 458 | 520 | 395 | 130 | 135 | 3.5 | 15.5 | 19 |
| 6 | COMPARATIVE EXAMPLE | 70 | 500 | 6 | 40 | 190 | 440 | 450 | 250 | 400 | 130 | 135 | 3.5 | 7.5 | 11 |

(56) References Cited

U.S. PATENT DOCUMENTS

| | | | | |
|---|---|---|---|---|
| 2019/0024224 | A1* | 1/2019 | Shibata | B22D 11/003 |
| 2019/0360083 | A1 | 11/2019 | Yoshida et al. | |
| 2020/0270729 | A1 | 8/2020 | Shibata et al. | |
| 2022/0154313 | A1* | 5/2022 | Shikama | C22C 21/10 |
| 2023/0357889 | A1 | 11/2023 | Shibata et al. | |

FOREIGN PATENT DOCUMENTS

| | | | | |
|---|---|---|---|---|
| JP | 2928445 | B2 | 8/1999 | |
| JP | 2006-316295 | A | 11/2006 | |
| JP | 2014-145119 | A | 8/2014 | |
| JP | 2019-039042 | A | 3/2019 | |
| JP | 2020-139228 | A | 9/2020 | |
| JP | 2020-164893 | A | 10/2020 | |
| JP | 2020-180321 | A | 11/2020 | |
| WO | 2018-100867 | A1 | 6/2018 | |
| WO | WO-2020195690 | A1 * | 10/2020 | C22C 21/10 |

OTHER PUBLICATIONS

International Search Report for corresponding International Patent Application No. PCT/JP2022/004678 dated Mar. 8, 2022, with English translation (6 Pages).

U.S. Appl. No. 18/351,826, filed Jul. 13, 2023, Karin Shibata, Method For Manufacturing Aluminum Alloy Extruded Material.

W, Skolaut (ed.) "Sustainable Production—Avoiding emissions and conserving resources"; DOI 10.1007/978-3-8274-25S4-6_33; Oc Springer-Verlag Berlin Heidelberg; Year 2014; pp. 1141-1158 (total 36 pages).

Shahani, "High Strength 7xxx Alloys for Ultra-Thick Aerospace Plate" Optimisation of Alloy Composition; Aluminum Alloys Their Physical and Mechanical Properties, vol. 2, Proceedings of the 6th International Conference on Aluminum Alloys; The Japan Institute of Light Metals, Jul. 1998; pp. 1105-1110.

Aluminum Association, "International Alloy Designations and Chemical Composition Limits for Wrought Aluminum and Wrought Aluminum Alloys"; Aluminum Association, Arlington, VA; pp. 1-29, Jan. 2018.

Mondolfo, "Aluminum-Zinc-Magnesium Alloys", Aluminum Alloys: Structures &Properties, pp. 844-864, Butterworths London-Boston; 1976.

Duplancic; "Effect of Process Parameters on the Properties of AlZnMg Alloy Extruded Hollow Shapes", Extrusion Technology Conference Proceedings 1992; pp. 559-570; Aluminum Extruders Council; May 1992.

Williamson; "Elevated Temperature Exposure Effects: A Comparison of 6xxx-Series and 7xxx-Series Alloys", Extrusion Technology Conference Proceedings 2016; pp. 113-123; Aluminum Extruders Council; May 2016.

ASTM B807/B807M-20 ASTM International; pp. 1-6, Jun. 2020.

* cited by examiner

FIG. 1

| | | ALLOY COMPONENTS [MASS%] | | | | | | | | | | [Mn+Zr +Sr] |
|---|---|---|---|---|---|---|---|---|---|---|---|---|
| | | Si | Fe | Cu | Mn | Mg | Cr | Zn | Zr | Sr | Ti | |
| 1 | EXAMPLE | 0.06 | 0.17 | 0.25 | 0.25 | 1.71 | 0.01 | 6.83 | 0.20 | 0.00 | 0.02 | 0.46 |
| 2 | EXAMPLE | 0.06 | 0.17 | 0.25 | 0.25 | 1.71 | 0.01 | 6.83 | 0.20 | 0.00 | 0.02 | 0.46 |
| 3 | EXAMPLE | 0.06 | 0.17 | 0.25 | 0.25 | 1.71 | 0.01 | 6.83 | 0.20 | 0.00 | 0.02 | 0.46 |
| 4 | EXAMPLE | 0.06 | 0.17 | 0.25 | 0.25 | 1.71 | 0.01 | 6.83 | 0.20 | 0.00 | 0.02 | 0.46 |
| 5 | EXAMPLE | 0.06 | 0.17 | 0.25 | 0.25 | 1.71 | 0.01 | 6.83 | 0.20 | 0.00 | 0.02 | 0.46 |
| 6 | EXAMPLE | 0.06 | 0.17 | 0.25 | 0.25 | 1.71 | 0.01 | 6.83 | 0.20 | 0.00 | 0.02 | 0.46 |
| 7 | EXAMPLE | 0.05 | 0.13 | 0.24 | 0.23 | 1.73 | 0.01 | 6.77 | 0.20 | 0.00 | 0.02 | 0.44 |
| 8 | EXAMPLE | 0.05 | 0.13 | 0.24 | 0.23 | 1.73 | 0.01 | 6.77 | 0.20 | 0.00 | 0.02 | 0.44 |
| 9 | EXAMPLE | 0.05 | 0.13 | 0.24 | 0.23 | 1.73 | 0.01 | 6.77 | 0.20 | 0.00 | 0.02 | 0.44 |
| 10 | EXAMPLE | 0.05 | 0.13 | 0.24 | 0.23 | 1.73 | 0.01 | 6.77 | 0.20 | 0.00 | 0.02 | 0.44 |
| 11 | EXAMPLE | 0.05 | 0.13 | 0.24 | 0.23 | 1.73 | 0.01 | 6.77 | 0.20 | 0.00 | 0.02 | 0.44 |
| 12 | EXAMPLE | 0.05 | 0.13 | 0.24 | 0.23 | 1.73 | 0.01 | 6.77 | 0.20 | 0.00 | 0.02 | 0.44 |
| 13 | EXAMPLE | 0.06 | 0.17 | 0.25 | 0.25 | 2.45 | 0.00 | 6.68 | 0.18 | 0.00 | 0.03 | 0.43 |
| 14 | EXAMPLE | 0.06 | 0.17 | 0.25 | 0.25 | 2.45 | 0.00 | 6.68 | 0.18 | 0.00 | 0.03 | 0.43 |
| 15 | EXAMPLE | 0.06 | 0.17 | 0.25 | 0.25 | 2.45 | 0.00 | 6.68 | 0.18 | 0.00 | 0.03 | 0.43 |
| 16 | EXAMPLE | 0.06 | 0.17 | 0.25 | 0.25 | 2.45 | 0.00 | 6.68 | 0.18 | 0.00 | 0.03 | 0.43 |
| 17 | EXAMPLE | 0.06 | 0.17 | 0.25 | 0.25 | 2.45 | 0.00 | 6.68 | 0.18 | 0.00 | 0.03 | 0.43 |
| 1 | COMPARATIVE EXAMPLE | 0.05 | 0.15 | 1.60 | 0.26 | 2.50 | 0.26 | 5.60 | 0.00 | 0.00 | 0.03 | 0.52 |
| 2 | COMPARATIVE EXAMPLE | 0.05 | 0.15 | 1.60 | 0.26 | 2.50 | 0.26 | 5.60 | 0.00 | 0.00 | 0.03 | 0.52 |
| 3 | COMPARATIVE EXAMPLE | 0.05 | 0.13 | 0.25 | 0.00 | 1.21 | 0.01 | 6.70 | 0.20 | 0.00 | 0.03 | 0.21 |
| 4 | COMPARATIVE EXAMPLE | 0.06 | 0.17 | 0.25 | 0.25 | 1.71 | 0.01 | 6.83 | 0.20 | 0.00 | 0.02 | 0.46 |
| 5 | COMPARATIVE EXAMPLE | 0.05 | 0.13 | 0.24 | 0.23 | 1.73 | 0.01 | 6.77 | 0.20 | 0.00 | 0.02 | 0.44 |
| 6 | COMPARATIVE EXAMPLE | 0.06 | 0.17 | 0.25 | 0.25 | 2.45 | 0.00 | 6.68 | 0.18 | 0.00 | 0.03 | 0.43 |

FIG. 2

| MANUFACTURING CONDITIONS | | CASTING RATE | HOMO | | AFTER HOMO | BILLET CRYSTAL GRAIN SIZE | BLT TEMPER-ATURE | PROFILE TEMPERATURE AFTER EXTRUDED | COOLING START PROFILE TEMPERATURE | COOLING RATE AFTER EXTRUDED | HEAT TREATMENT CONDITIONS | | | | |
|---|---|---|---|---|---|---|---|---|---|---|---|---|---|---|---|
| | | | TEMPER-ATURE | TIME PERIOD | COOLING RATE | | | | | | FIRST-STAGE TEMPE-RATURE | SECOND-STAGE TEMPE-RATURE | FIRST-STAGE TIME PERIOD | SECOND STAGE TIME PERIOD | ENTIRE TIME PERIOD |
| | | 50 mm/min OR HIGHER | 480~520℃ | 1~14hr | 50°C/hr OR HIGHER | 250 μm OR LESS | 400°C OR HIGHER | 325°C OR HIGHER | 325~550℃ | 50~750 ℃/min | 90~130℃ | 130~180℃ | 1~8hr | 1~20hr | 3~24hr |
| 1 | EXAMPLE | 70 | 495 | 6 | 100 | 180 | 503 | 450 | 350 | 372 | 130 | 135 | 3.5 | 7.5 | 11 |
| 2 | EXAMPLE | 70 | 495 | 6 | 100 | 180 | 503 | 450 | 350 | 372 | 130 | 135 | 3.5 | 7.5 | 11 |
| 3 | EXAMPLE | 70 | 495 | 6 | 100 | 200 | 500 | 453 | 400 | 383 | 130 | 135 | 3.5 | 7.5 | 11 |
| 4 | EXAMPLE | 70 | 495 | 6 | 100 | 200 | 500 | 453 | 400 | 383 | 130 | 135 | 3.5 | 7.5 | 11 |
| 5 | EXAMPLE | 70 | 495 | 6 | 100 | 190 | 505 | 463 | 520 | 392 | 130 | 135 | 3.5 | 7.5 | 11 |
| 6 | EXAMPLE | 70 | 495 | 6 | 100 | 190 | 505 | 463 | 520 | 392 | 130 | 135 | 3.5 | 7.5 | 11 |
| 7 | EXAMPLE | 70 | 490 | 5 | 100 | 185 | 498 | 452 | 350 | 385 | 130 | 135 | 3.5 | 15.5 | 19 |
| 8 | EXAMPLE | 70 | 490 | 5 | 100 | 185 | 498 | 452 | 350 | 385 | 130 | 135 | 3.5 | 15.5 | 19 |
| 9 | EXAMPLE | 70 | 490 | 5 | 100 | 195 | 502 | 455 | 400 | 380 | 130 | 135 | 3.5 | 15.5 | 19 |
| 10 | EXAMPLE | 70 | 490 | 5 | 100 | 195 | 502 | 455 | 400 | 380 | 130 | 135 | 3.5 | 15.5 | 19 |
| 11 | EXAMPLE | 70 | 490 | 5 | 100 | 190 | 506 | 458 | 520 | 395 | 130 | 135 | 3.5 | 15.5 | 19 |
| 12 | EXAMPLE | 70 | 490 | 5 | 100 | 190 | 506 | 458 | 520 | 395 | 130 | 135 | 3.5 | 15.5 | 19 |
| 13 | EXAMPLE | 70 | 500 | 6 | 120 | 180 | 440 | 448 | 325 | 392 | 130 | 135 | 3.5 | 7.5 | 11 |
| 14 | EXAMPLE | 70 | 500 | 6 | 120 | 180 | 440 | 448 | 350 | 388 | 130 | 135 | 3.5 | 7.5 | 11 |
| 15 | EXAMPLE | 70 | 500 | 6 | 120 | 180 | 440 | 448 | 400 | 390 | 130 | 135 | 3.5 | 7.5 | 11 |
| 16 | EXAMPLE | 70 | 500 | 6 | 120 | 190 | 440 | 450 | 350 | 400 | 130 | 135 | 3.5 | 15.5 | 19 |
| 17 | EXAMPLE | 70 | 500 | 6 | 120 | 190 | 440 | 450 | 400 | 400 | 130 | 135 | 3.5 | 15.5 | 19 |
| 1 | COMPARATIVE EXAMPLE | 60 | 480 | 12 | 100 | 300 | 430 | 440 | 400 | 380 | 120 | 140 | 4.5 | 12.5 | 19 |
| 2 | COMPARATIVE EXAMPLE | 60 | 480 | 12 | 100 | 300 | 430 | 440 | 400 | 850 | 120 | 140 | 6.5 | 12.5 | 19 |
| 3 | COMPARATIVE EXAMPLE | 80 | 520 | 6 | 90 | 225 | 450 | 473 | 520 | 100 | 95 | 140 | 4.5 | 14.5 | 19 |
| 4 | COMPARATIVE EXAMPLE | 70 | 495 | 6 | 100 | 180 | 503 | 450 | 250 | 372 | 130 | 135 | 3.5 | 7.5 | 11 |
| 5 | COMPARATIVE EXAMPLE | 70 | 490 | 5 | 40 | 190 | 506 | 458 | 520 | 395 | 130 | 135 | 3.5 | 15.5 | 19 |
| 6 | COMPARATIVE EXAMPLE | 70 | 500 | 6 | 40 | 190 | 440 | 450 | 250 | 400 | 130 | 135 | 3.5 | 7.5 | 11 |

FIG. 3

| EVALUATION | | T5 TENSILE STRENGTH [MPa] | T5 YIELD STRENGTH [MPa] | T5 ELONGATION [%] | SCC | MICROSTRUCTURE SURFACE RECRYSTALLIZATION DEPTH | COMPREHENSIVE JUDGEMENT |
|---|---|---|---|---|---|---|---|
| | | 480 MPa OR MORE | 460 MPa OR MORE | 10% OR MORE | 720 cyc OR MORE | 150 μm OR LESS | |
| 1 | EXAMPLE | 519 | 489 | 14 | 720 | 10 | ○ |
| 2 | EXAMPLE | 521 | 482 | 12 | 720 | 10 | ○ |
| 3 | EXAMPLE | 524 | 493 | 15 | 720 | 10 | ○ |
| 4 | EXAMPLE | 528 | 488 | 13 | 720 | 10 | ○ |
| 5 | EXAMPLE | 526 | 486 | 14 | 720 | 10 | ○ |
| 6 | EXAMPLE | 527 | 488 | 14 | 720 | 10 | ○ |
| 7 | EXAMPLE | 526 | 500 | 14 | 720 | 20 | ○ |
| 8 | EXAMPLE | 527 | 497 | 15 | 720 | 20 | ○ |
| 9 | EXAMPLE | 528 | 503 | 15 | 720 | 20 | ○ |
| 10 | EXAMPLE | 530 | 500 | 16 | 720 | 20 | ○ |
| 11 | EXAMPLE | 538 | 508 | 15 | 720 | 20 | ○ |
| 12 | EXAMPLE | 528 | 498 | 15 | 720 | 20 | ○ |
| 13 | EXAMPLE | 587 | 530 | 11 | 720 | 15 | ○ |
| 14 | EXAMPLE | 583 | 547 | 13 | 720 | 15 | ○ |
| 15 | EXAMPLE | 585 | 545 | 12 | 720 | 15 | ○ |
| 16 | EXAMPLE | 577 | 546 | 11 | 720 | 20 | ○ |
| 17 | EXAMPLE | 588 | 561 | 11 | 720 | 20 | ○ |
| 1 | COMPARATIVE EXAMPLE | 497 | 426 | 12 | 240 | 200 | × |
| 2 | COMPARATIVE EXAMPLE | 557 | 506 | 12 | 240 | 200 | × |
| 3 | COMPARATIVE EXAMPLE | 462 | 421 | 14 | 720 | 20 | × |
| 4 | COMPARATIVE EXAMPLE | 474 | 446 | 15 | 720 | 10 | × |
| 5 | COMPARATIVE EXAMPLE | 495 | 452 | 14 | 720 | 20 | × |
| 6 | COMPARATIVE EXAMPLE | 517 | 458 | 12 | 720 | 20 | × |

METHOD FOR MANUFACTURING ALUMINUM ALLOY EXTRUDED MATERIAL WITH HIGH STRENGTH AND EXCELLENT IN SCC RESISTANCE AND HARDENABILITY

CROSS REFERENCE TO RELATED APPLICATIONS

This application is a continuation of International Patent Application No. PCT/JP2022/004671, having an international filing date of Feb. 7, 2022, which designated the United States, the entirety of which is incorporated herein by reference. Japanese Patent Application No. 2021-028172 filed on Feb. 25, 2021 is also incorporated herein by reference in its entirety.

BACKGROUND OF THE INVENTION

The present disclosure relates to a method for manufacturing an extruded material using an Al—Zn—Mg-based aluminum alloy.

Al—Mg—Si-based 6000 series alloys, and Al—Zn—Mg-based 7000 series alloys are known as high-strength aluminum alloys, and 7000 series alloys are considered to have relatively good extrusion workability.

In recent years, application of aluminum alloys to structural members for vehicles has been studied for the purpose of reducing the weight of the vehicles.

Structural members for vehicles are required to have bending workability and corrosion resistance in addition to high strength.

In particular, stress corrosion cracking resistance is also important in a use environment where stress is applied.

Here, stress corrosion cracking resistance is expressed as SCC resistance from stress corrosion cracking.

For example, JP-A-2014-145119 discloses an extruded material made of an Al—Zn—Mg-based aluminum alloy by performing restoration treatment and squeezing after extrusion, the extruded material using an aluminum alloy containing 3.0 to 8.0 wt % of Zn, 0.4 to 2.5 wt % of Mg, 0.05 to 2.0 wt % of Cu, and 0.001 to 0.2 wt % of Ti, and containing one kind or two or more kinds of 0.01 to 0.3 wt % of Cr, 0.01 to 0.3 wt % of Mn, and 0.01 to 0.3 wt % of Zr.

The aluminum alloy disclosed in the same publication contains relatively large amounts of three types of transition elements, Mn, Cr, and Zr, in order to suppress the recrystallization depth on the surface of the extruded material.

In particular, Cr has a great effect on the hardenability after extrusion, and high strength cannot be obtained without cooling at a high cooling rate of a water-cooling level after extrusion.

Further, since restoration treatment that heats the extruded material to 400° C. or higher is carried out, the depth of the recrystallized layer on the surface of the extruded material may increase, formability such as bending may deteriorate, and further, stress corrosion cracking resistance may be insufficient.

Looking at the examples of the same publication, the yield strength is insufficient at 450 MPa or less, and those with yield strengths of 450 MPa or more are inferior in SCC resistance.

JP-B-2928445 discloses an aluminum alloy containing 5.0 to 7.0 wt % of Zn, 1.0 to 1.50 wt % of Mg, 0.1 to 0.3 wt % of Cu, 0.05 to 0.20 wt % of Zr, 0.03 to 0.2 wt % of Cr, 0.3 wt % or less of Mn, and 0.001 to 0.05 wt % of Ti.

Since the aluminum alloy disclosed in the same publication also contains 0.03 to 0.2 wt % of Cr, it has an insufficient strength in a yield strength at a level of 400 MPa, and an insufficient SCC resistance.

BRIEF DESCRIPTION OF THE DRAWINGS

FIG. 1 illustrates compositions of aluminum alloys used for evaluation.

FIG. 2 illustrates billet casting and extrusion conditions.

FIG. 3 illustrates evaluation results of extruded materials.

DESCRIPTION OF EMBODIMENTS

The following disclosure provides many different embodiments, or examples, for implementing different features of the provided subject matter. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Further, when a first element is described as being "connected" or "coupled" to a second element, such description includes embodiments in which the first and second elements are directly connected or coupled to each other, and also includes embodiments in which the first and second elements are indirectly connected or coupled to each other with one or more other intervening elements in between.

The disclosure has an object to provide a method for manufacturing an aluminum alloy extruded material that has high strength obtained at a cooling rate of an air-cooling level of quench hardening after extrusion of the extruded material, and is excellent in SCC resistance.

The present inventors have studied various manufacturing conditions that are excellent in productivity and improve SCC resistance while securing high strength.

As a result, the inventors wondered whether it was possible to obtain the target extruded material while suppressing addition of Cr to suppress the recrystallization depth on the surface of the extruded material, and conducted a factor analysis along the flow of the billet casting and extrusion from the study of the composition of the aluminum alloy, as a result of which, the inventors have achieved the disclosure.

The flow of manufacturing of the extruded material of an aluminum alloy includes steps as follows.

(1) Adjust the composition of the aluminum alloy.

(2) Heat and melt the aluminum alloy to cast a billet (at this stage, the billet is a continuously cast long billet).

(3) Since microscopic segregation occurs in the cast billet during solidification, reheat the cast billet to eliminate this microscopic segregation.

This process is referred to as homogenization treatment.

(4) The long billet subjected to homogenization treatment becomes a billet for extrusion that is cut into a predetermined length.

(5) The above-referenced billet is loaded into a container of an extruder after being preheated to a predetermined temperature, and extruded into a long-extruded material through an extrusion die by a direct extrusion method, an indirect extrusion method, or the like.

(6) The extrusion belongs to the field of hot working, and the extruded material is at a high temperature immediately after being extruded from the extrusion die and is cooled to a predetermined temperature by an air-cooling or a water-cooling.

This process is referred to as quench hardening and is also called die edge quench hardening especially when quench hardening is performed immediately after extrusion.

(7) The extruded material obtained as described above is subjected to a heat treatment called artificial aging treatment, whereby high strength can be obtained by precipitation hardening.

The inventors focused on the point that it has become clear that the homogenization treatment process of the cast billets is also important although the composition of the aluminum alloy is an important factor.

The method according to the disclosure for manufacturing an aluminum alloy extruded material having a high strength and excellent in SCC resistance and hardenability comprises: casting a billet of an aluminum alloy composition including, by mass: 6.0 to 8.0% of Zn, 1.5 to 3.0% of Mg, 0.20 to 1.50% of Cu, 0.10 to 0.25% of Zr, 0.005 to 0.05% of Ti, 0.15 to 0.35% of Mn, 0.25% or less of Sr, and 0.25 to 0.50% of a total of [Mn+Zr+Sr], and a balance including Al and unavoidable impurities, cooling the billet at a rate equal to or higher than a cooling rate of 50° C./hr after homogenization treatment at 480 to 520° C. for 1 to 14 hours, extruding an extruded material by using the billet subjected to the homogenization treatment so that a temperature of the extruded material directly after extruding becomes 325 to 550° C., cooling the extruded material at a rate of a cooling rate of 50 to 750° C./min directly after extruding, and applying two-stage artificial aging treatment at 90 to 130° C. for 1 to 8 hours and at 130 to 180° C. for 1 to 20 hours to the extruded material.

When manufactured in this manner, a tensile strength of 480 MPa or more and a 0.2% yield strength of 460 MPa or more can be obtained.

Further, as for the SCC resistance, as a result of carrying out 720 cycles when the test conditions below are set as one cycle, no crack occurs in a test piece.

Test Conditions

One Cycle

The one cycle has a step of immersing the test piece into a 3.5% NaCl aqueous solution at 25° C., for 10 minutes in a state in which a stress of an 80% yield strength value is applied to the test piece, a step of thereafter holding the test piece for 50 minutes in an atmosphere of 25° C. and 40% humidity, and a step of thereafter allowing the test piece to naturally dry.

Next, the reason for selecting the aluminum alloy composition will be described.

Zn Component

In a 7000 series aluminum alloy, a Zn component has the highest content, since there is little decrease in extrudability even at a relatively high concentration.

However, when Zn is excessively added, stress corrosion cracking resistance is deteriorated, and therefore, a range of 6.0 to 8.0% by mass of Zn is preferable.

Mg Component

An Mg component is an important additive component along with Zn because high strength is obtained by precipitates of $MgZn_2$ with the Zn component, but as the addition amount increases, the extrudability deteriorates and bending formability also deteriorates, so that a range of 1.5 to 3.0% by mass of Mg is preferable.

Cu Component

A Cu component improves the strength by solid solution, and has an action of lowering the potential difference with a PF zone by existing together with $MgZn_2$ in the crystal grain boundary of the metal texture, thereby improving the SCC resistance.

Here, the PF zone refers to regions (Precipitate-Free-Zone) without precipitates observed on both sides of the grain boundary.

However, when Cu is excessively added, extrudability is deteriorated, and general corrosion resistance is deteriorated, so that a range of 0.20 to 1.5% by mass of Cu is preferable.

Zr, Mn, AND Cr Components

Zr, Mn and Cr components are all transition elements that have an action of suppressing the depth of the recrystallized layer formed on the surface of the extruded material at the time of extrusion, and an effect of refining crystal grains, and improve the SCC resistance.

However, there are differences in the effects on quench hardening immediately after extrusion, the Cr component makes the quench hardening sensitivity the sharpest, and the required high strength cannot be obtained without high-speed cooling at a water-cooling level in die edge quench hardening.

It is the Mn component that sharpens the quench hardening sensitivity next, and the Zr component is the least sensitive to quench hardening, so that in the disclosure, adjustment is made by addition of Zr and Mn, and the Cr component is reduced as much as possible.

Accordingly, it is preferable that a range of 0.10 to 0.25% by mass of Zr and a range of 0.15 to 0.35% by mass of Mn are set, and Cr is not preferably added, and if Cr is added, it is preferable to keep the level of unavoidable impurities below 0.05% by mass.

Sr Component

The Sr component has a great effect on the crystal structure when casting billets, and adding a very small amount of the Sr component suppresses coarsening of crystal grains and suppresses recrystallization on the surface of the extruded material during extrusion.

Although not an essential component in the disclosure, 0.25% by mass or less of Sr is preferably added.

However, when Sr is excessively added, coarse crystallized substances appear and the strength decreases, so that it is necessary to adjust the amount of Sr with the amount of addition of the transition elements, and a total of [Mn+Zr+Sr] is set in a range of 0.25 to 0.50% by mass.

Ti Component

A Ti component is effective in refining crystal grains during billet casting, and Ti is preferably in a range of 0.005 to 0.05% by mass.

Note that a very small amount of B is often contained.

Fe and Si Components

These components are often contained as unavoidable impurities in the process of casting billets of an aluminum alloy, but when excessively included, the strength, SCC resistance, and formability are deteriorated, and therefore, it is preferable to suppress Fe to 0.2% by mass or less, and Si to 0.1% by mass or less.

Next, casting and homogenization treatment of a billet will be descried.

A billet for extrusion is generally continuously cast as a long cylindrical billet.

As a casting method, various methods such as a hot top casting method and a float type casting method are performed, and in either case, the aluminum alloy is casted into a long cylindrical billet by being cooled from a periphery at a bottom part of a casting mold or a lower side of the casting mold and being solidified.

The billet used in the disclosure preferably has a casting structure of a fine structure composed of fine crystal grains, and a casting rate at which it is cooled and solidified, and cast on the lower side of the casting mold is preferably 50 mm/min or higher, and as a result, the fine structure of the billet preferably becomes a casting structure with an average grain size of 250 μm or less, more preferably 200 μm or less.

What is characteristic in the disclosure is cooling after homogenization treatment is applied to the cast billet.

When billets are continuously cast, reheating (homogenization treatment) is performed at 480 to 520° C. for 1 to 14 hours in a continuous furnace or batch furnace to eliminate microscopic segregation that occurs during the process of the molten metal being rapidly cooled and solidified.

Conventionally, furnace cooling that is cooling in a furnace, or allowing the billet to cool as it is after heating have been performed.

In this case, the cooling rate after the homogenization treatment was uneven, and the cooling rate was as slow as lower than 50° C./hr, so that the strength of the extruded material obtained by being extruded subsequently was insufficient.

Thus, in the disclosure, by performing cooling management so that the cooling rates after the homogenization treatment of billets become 50° C./hr or higher, high strength is stably obtained thereafter.

The extrusion conditions will be described.

An extruder has a container with an extrusion die attached to a front side, a cylindrical billet is loaded into the container, and is hot-extruded from behind by a stem or the like.

Here, the billet is loaded into the container in a state in which the billet is preheated to 400° C. or higher, preferably 430 to 510° C., and extruded.

The extruded material extruded by hot working also has a high temperature due to heat of working, but it is preferable to secure 440° C. or higher in order to sufficiently perform subsequent quench hardening, and at least 325° C. or higher is required at a time of start of cooling by air cooling.

Further, when the temperature of the extruded material directly after extrusion exceeds 550° C., it is not preferable because gouge defects tend to occur in an appearance.

For the extruded material extruded as described above, die edge quench hardening by air cooling is performed.

The cooling rate in a range of 50 to 750° C./min is secured by fan air cooling or the like.

In conventional water-cooling, the extruded material has been often locally cooled rapidly, and strain deformation such as cross-sectional deformation has easily occurred in the extruded material, whereas in the disclosure, high strength is sufficiently obtained by air cooling, and cooling strain deformation can also be suppressed.

The artificial aging treatment after extrusion will be described.

An extruded material made of a 7000 series aluminum alloy can obtain high strength by precipitating G. P. zones and intermediate phases in the crystal structure of the extruded material, and a two-stage artificial aging treatment is performed at 90 to 130° C. for 1 to 8 hours for a first stage, and at 130 to 180° C. for 1 to 20 hours for a second stage.

In the disclosure, by using the manufacturing process as described above, the extruded material with a high strength and excellent in SCC resistance can be obtained by the die edge quench hardening at the air-cooling level, and productivity is improved.

Exemplary embodiments are described below. Note that the following exemplary embodiments do not in any way limit the scope of the content defined by the claims laid out herein. Note also that all of the elements described in the present embodiment should not necessarily be taken as essential elements Compositions of various aluminum alloys were adjusted, and cylindrical billets with a diameter of 8 inches were experimentally produced and evaluated while examining extrusion conditions, as will be described below.

Long billets of 8 inches were cast at casting rates shown in a table of FIG. 2 by using molten metals of aluminum alloys having various alloy compositions shown in a table of FIG. 1.

Next, directly after homogenization treatment was performed under homogenization treatment conditions shown as "HOMO" in the table of FIG. 2, cooling was carried out under conditions of "cooling rate after HOMO" in the table of FIG. 2.

Note that respective conditions shown in the table show conditions suitable for the disclosure.

In the table, "billet crystal grain size" was obtained by measuring a value of an average crystal grain size by an optical microscope after cutting out a test piece of a cast cross-section from a billet, and applying polishing and etching to the test piece.

In the table, "BLT temperature" indicates a preheating temperature when the billet is loaded into a container of an extruder, "profile temperature after extrusion" indicates a surface temperature of an extruded material directly after extrusion, "profile temperature at the start of cooling" and "cooling rate after extrusion" indicate a surface temperature of the extruded material at a start of die edge quench hardening and a cooling rate by fan air cooling.

In the table, "heat treatment conditions" indicate the conditions and a treatment time period of artificial aging treatment.

Evaluation results are shown in a table of FIG. 3.

"T5 tensile strength", "T5 yield strength", and "T5 elongation" in the table were measured by cutting out JIS-Z2241 and JIS-5 test pieces in an extruding direction from the extruded materials subjected to the two-stage artificial aging treatment by a tensile tester conforming to JIS standards.

As for "SCC" in the table, presence or absence of cracks was evaluated by cutting out the extruded material into test pieces in the extruding direction, applying 80% of stress of a 0.2% yield strength value shown in "T5 yield strength" in the table in a bending direction, and carrying out 720 cycles under the following conditions.

In the table, "circle" indicates that no crack occurred.

SCC Resistance Test One cycle

After the test pieces were immersed into a 3.5% NaCl aqueous solution at 25° C., for 10 minutes, the test pieces were held in an atmosphere of 25° C. and 40% humidity for 50 minutes, and thereafter taken out from a test furnace to dry naturally.

As for "microstructure, surface recrystallization depth" in the table, an extruded cross-section of the extruded material was polished and etched, and the depth of the recrystallized layer formed on a surface side of the extruded material was measured by an optical microscope.

Based on the evaluation results illustrated in FIG. 3, examples 1 to 16 cleared all evaluation items.

In contrast, comparative examples will be discussed.

Although in comparative examples 1 and 2, the tensile strengths achieved the targets, yield strengths and SCC resistances were below the targets, and it is presumed that the reason is that the Cu component was 1.60% and exceeded 1.50% set by the disclosure, and that 0.26% of Cr was contained.

In comparative example 3, the Mg content was as low as 1.21%, and the strength was insufficient.

In comparative example 4, the cooling start temperature in the die edge quench hardening was as low as 250° C., and therefore, the strength was insufficient.

In comparative examples 5 and 6, the compositions of the aluminum alloys were within the set composition, but the cooling rates after the homogenization treatment for the billets were 40° C./hr, being lower than a setting according to the disclosure, and therefore, the strengths were insufficient.

The product according to the disclosure has a high strength and is excellent in SCC resistance, and therefore can be used for structural members of vehicles and various machines.

What is claimed is:

1. A method for manufacturing an aluminum alloy extruded material, the method comprising:

casting a billet of an aluminum alloy composition including, by mass: 6.0 to 8.0% of Zn, 1.5 to 3.0% of Mg, 0.20 to 1.50% of Cu, 0.10 to 0.25% of Zr, 0.005 to 0.05% of Ti, 0.15 to 0.35% of Mn, 0.25% or less of Sr, and 0.25 to 0.50% of a total of [Mn+Zr+Sr], and a balance including Al and unavoidable impurities;

cooling the billet at a rate equal to or higher than a cooling rate of 50° C./hr after homogenization treatment at 480 to 520° C. for 1 to 14 hours;

extruding an extruded material by using the billet subjected to the homogenization treatment;

cooling the extruded material at a rate of a cooling rate of 50 to 750° C./min after the temperature of the extruded material is dropped by 48° C. or more to 325 to 400° C. directly after extruding; and applying two-stage artificial aging treatment at 90 to 130° C. for 1 to 8 hours and at 130 to 180° C. for 1 to 20 hours to the extruded material.

2. The method for manufacturing an aluminum alloy extruded material according to claim 1, wherein a tensile strength is equal to or more than 480 MPa, and a 0.2% yield strength is equal to or more than 460 MPa.

3. The method for manufacturing an aluminum alloy extruded material according to claim 2, wherein as for the SCC resistance, no crack occurs in a test piece as a result of carrying out 720 cycles when test conditions below are set as one cycle:

Test conditions

The one cycle includes:

immersing the test piece into a 3.5% NaCI aqueous solution at 25° C. for 10minutes in a state in which stress of an 80% yield strength value is applied to the test piece;

thereafter, holding the test piece in an atmosphere of 25° C. and 40% humidity for 50 minutes; and thereafter, allowing the test piece to dry naturally.

* * * * *